US008333415B2

(12) United States Patent
Chang et al.

(10) Patent No.: US 8,333,415 B2
(45) Date of Patent: Dec. 18, 2012

(54) INERTIA BALANCED VEHICLE OUTSIDE DOOR HANDLE

(75) Inventors: Houng Yue Chang, Canton, MI (US); Ching-Hui Chiang, Ann Arbor, MI (US); Ian S. Buckley, Swartz Creek, MI (US); Chu M. Tai, Troy, MI (US); Michael J. Wightman, Fowlerville, MI (US); Carolyn J. Thor, Lake Orion, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 516 days.

(21) Appl. No.: 12/549,859

(22) Filed: Aug. 28, 2009

(65) Prior Publication Data

US 2010/0276949 A1 Nov. 4, 2010

Related U.S. Application Data

(60) Provisional application No. 61/175,078, filed on May 4, 2009.

(51) Int. Cl.
*E05B 3/00* (2006.01)
*E05B 65/10* (2006.01)

(52) U.S. Cl. ..... 292/336.3; 292/92; 292/DIG. 8; 292/DIG. 22; 292/DIG. 65

(58) Field of Classification Search ..... 292/92, 292/336.3, DIG. 8, DIG. 22, DIG. 31, DIG. 65
See application file for complete search history.

(56) References Cited

U.S. PATENT DOCUMENTS

| | | | | |
|---|---|---|---|---|
| 6,007,122 | A * | 12/1999 | Linder et al. | 292/336.3 |
| 7,232,164 | B2 * | 6/2007 | Lee | 292/336.3 |
| 8,029,032 | B1 * | 10/2011 | Yang | 292/336.3 |
| 2010/0088855 | A1 * | 4/2010 | Ruse et al. | 16/412 |
| 2010/0171327 | A1 * | 7/2010 | Muller et al. | 292/336.3 |
| 2010/0325841 | A1 * | 12/2010 | Savant et al. | 16/412 |
| 2011/0204662 | A1 * | 8/2011 | Savant et al. | 292/336.3 |

FOREIGN PATENT DOCUMENTS

| | | | |
|---|---|---|---|
| DE | 2023859 | A1 | 11/1971 |
| DE | 102007010628 | A1 | 9/2008 |
| DE | 102007027845 | A1 | 12/2008 |
| WO | 2008151949 | A1 | 12/2008 |

* cited by examiner

*Primary Examiner* — Carlos Lugo
*Assistant Examiner* — Alyson M Merlino

(57) ABSTRACT

A door handle assembly for use with a vehicle door comprising a door paddle including an actuation arm, supported to pivot about a first axis such that lateral acceleration of the paddle and actuation arm relative to the door produces a first moment about the first axis, and masses engaged with the actuation arm and supported to pivot about a second axis, the masses being arranged such that lateral acceleration of the masses relative to the door produces a second moment about the first axis that is substantially equal in magnitude and opposite in direction to the first moment.

7 Claims, 5 Drawing Sheets

INERTIA BALANCED VEHICLE OUTSIDE DOOR HANDLE

CROSS REFERENCE TO RELATED APPLICATIONS

This application claims priority to and the benefit of U.S. Provisional Application No. 61/175,078, filed May 4, 2009, the full disclosure of which is incorporated herein by reference.

BACKGROUND OF INVENTION

This invention relates generally to the door latching mechanism of a motor vehicle occupant entry door, and more particularly to counterbalanced, pivoting masses incorporated in the door latching mechanism.

The door paddle (sometimes called a pull bar or handle), located on the outside of the door, is manually gripped and pivoted to unlatch and open the door so that an occupant can enter the vehicle. During an impact event, the impact force, which can come from any direction, produces inertial forces acting on the components of the door handle assembly and has a tendency to unlatch the door. As a result of an impact event, the highest inertia force is applied to the door handle paddle and can be directed such that the inertia force may unlatch and open the door.

To reduce this tendency, a conventional handle design uses a high spring torque, which requires high unlatching effort to open the door, and a counter balanced mass located on top of a bell crank. The high unlatching effort produces the perception of low quality design.

If a door handle mechanism has a counter balanced mass on the top of the bell crank, the mass has the rotational axis perpendicular to the pull bar axis, and the inertial load from the pull bar cannot be balanced entirely. The conventional design cannot be tuned to have an inertia load capacity (usually referred to as a high G-load capacity) due to rotational motion of the mass.

A need exists in the industry for a door whose handle components have a high G-load capacity, so that the door remains latched during impact. Preferably the door handle components would require low unlatching effort, thereby indicating high quality design and manufacture.

SUMMARY OF INVENTION

A door handle assembly for use with a vehicle door comprising a door paddle including a actuation arm, supported to pivot about a first axis such that lateral acceleration of the paddle and actuation arm relative to the door produces a first moment about the first axis, and masses engaged with the actuation arm and supported to pivot about a second axis, the masses being arranged such that lateral acceleration of the masses relative to the door produces a second moment about the first axis that is substantially equal in magnitude and opposite in direction to the first moment.

The vehicle outside door handle requires low unlatching effort, provides high G-load capacity in any direction, and reduces latching system cost.

DETAILED DESCRIPTION

Figure 1:
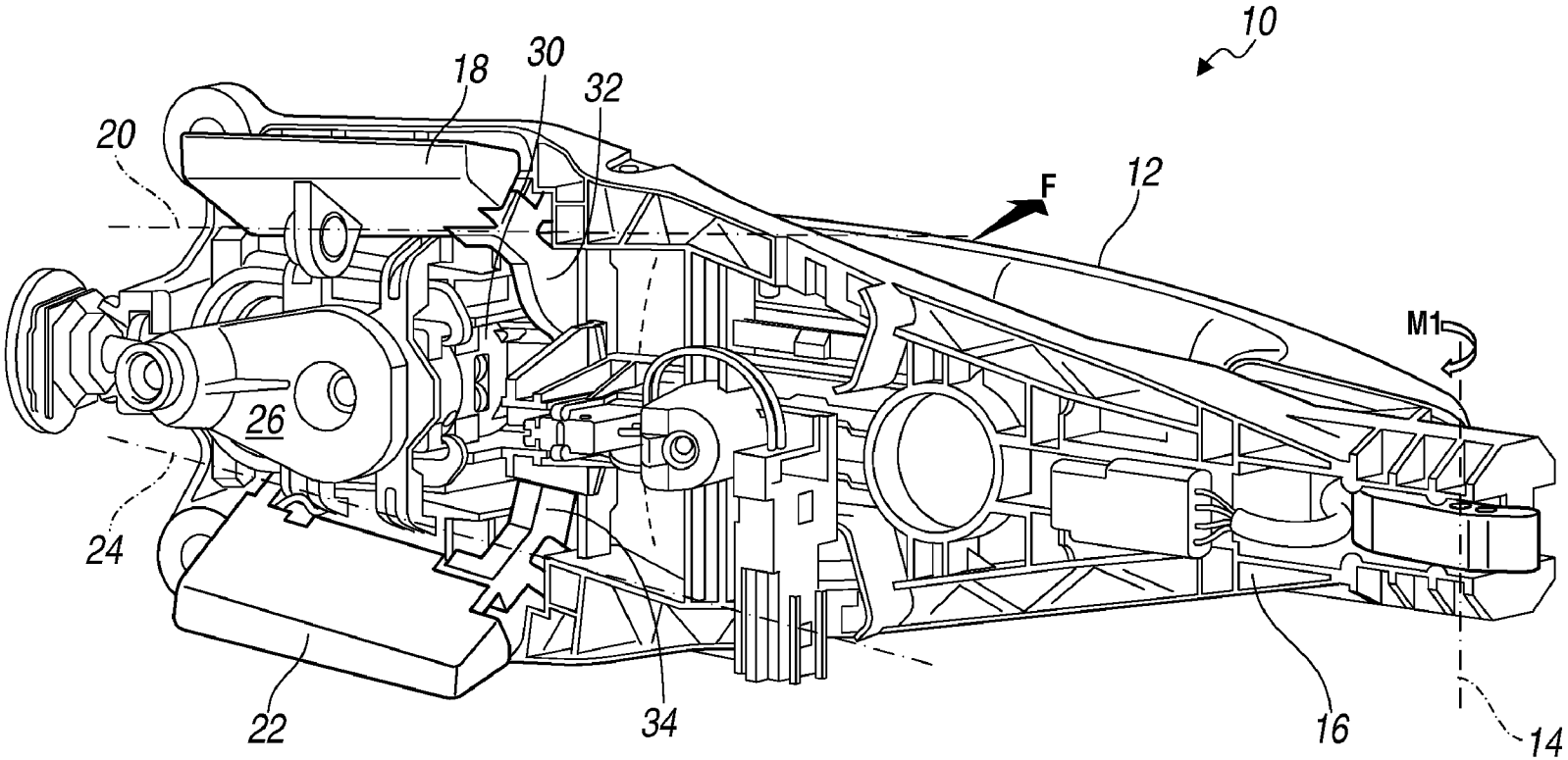
FIG. 1 is a perspective view of a door handle assembly according to a first embodiment.

FIG. 1 shows an inboard view of a first embodiment of a door handle assembly 10 for a vehicle side door, in which the door paddle 12 is pivoted outboard about its pivot axis 14. A bracket 16, which is bolted to the inside of the door, supports the door paddle 12 at axis 14, an upper mass 18 at its pivot axis 20, and a lower mass 22 at its pivot axis 24. A key cylinder lever 26 rotates in response to rotation of a door key to lock and unlock the door.

An actuation arm 30, secured to door paddle 12 and extending through an opening in bracket 16, is continually engaged by arms 32, 34 formed integrally on the two masses 18, 22, respectively.

In operation, when the door paddle is pulled, actuation arm 30 moves outboard from the position shown in FIG. 1, which causes mass 18 to pivot about axis 20 downward and inboard, and mass 22 to pivot about axis 24 upward and inboard. While the door paddle 12 is accelerated, masses 18 and 22 apply forces through the door paddle actuation arm 30 such that those forces produce a balanced moment about axis 14 when viewed as in FIG. 1.

In the event of a vehicle impact event, lateral acceleration of the door paddle 12 relative to the bracket 16 produces an outboard directed inertia force F on the door paddle and a clockwise moment M1 about axis 14. Lateral acceleration also produces outboard inertia force on masses 18, 22, which pivots the masses outboard about axes 20, 24, respectively, applies an inboard reaction on actuation arm 30 and a counterclockwise moment about axis 14, which is balanced by the clockwise moment M1 produced by outboard inertia force on the door paddle 12. Because these moments are equal in magnitude and opposite in direction, the door paddle 12 remains stationary. The counterbalanced masses 18, 22 are arranged such that they cancel each other's vertical inertia and produce very high G-force capacity in any direction of the inertia forces.

Figure 2:
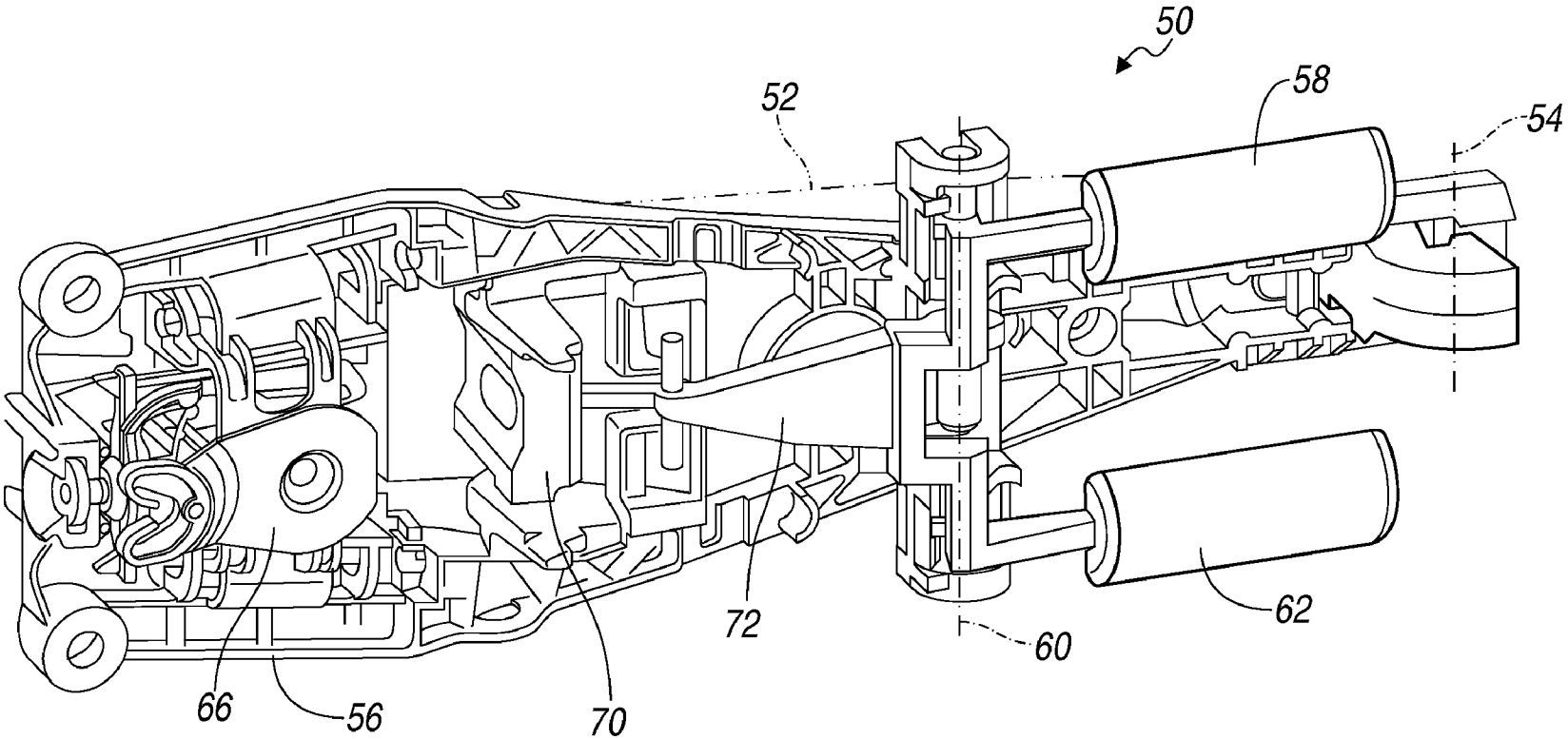
FIG. 2 is a perspective view of a door handle assembly according to a second embodiment.
Figure 3:
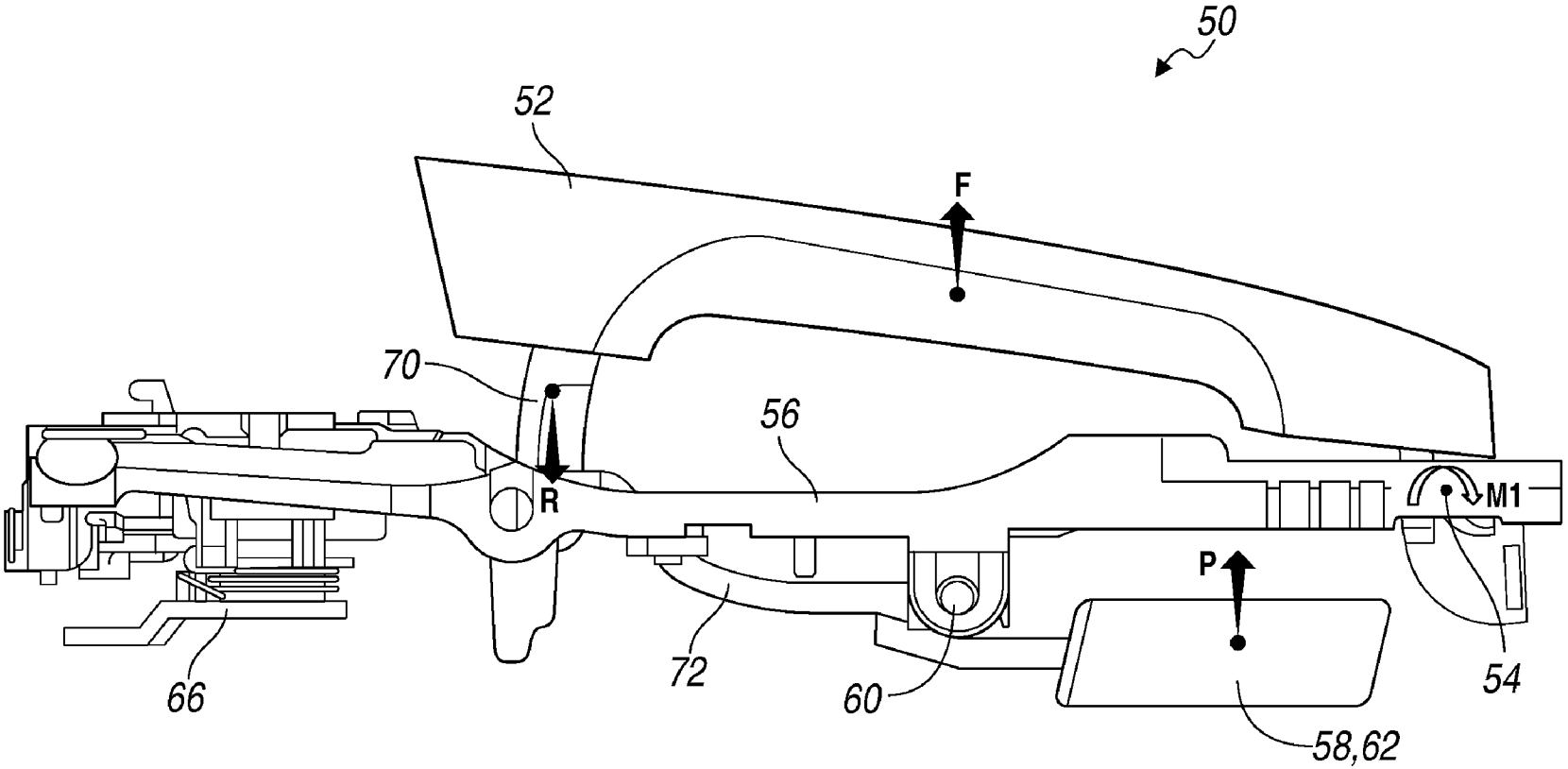
FIG. 3 is a top view of the door handle assembly of FIG. 2, with the handle in the open position.

FIG. 2 is an inboard view of a second embodiment of a door handle assembly 50 for a passenger side door showing the door paddle 52 pivoted outboard about its pivot axis 54. FIG. 3 is a top view of FIG. 2. A bracket 56, which is bolted to the inside of the door, supports the door paddle 52 at axis 54, an upper mass 58 and lower mass 62 at their pivot axis 60. A key cylinder lever 66 rotates in response to rotation of a door key to lock and unlock the door.

An actuation arm 70, secured to door paddle 52 and extending through an opening in bracket 56, is continually engaged by an arm 72 formed integrally with the two masses 58, 62 and extending forward from axis 60.

In operation, when the door paddle 52 is pulled, actuation arm 70 moves outboard from the position shown in FIGS. 2 and 3, causing masses 58, 62 to pivot clockwise about axis 60, and the door paddle to pivot clockwise about axis 54.

Figure 4:
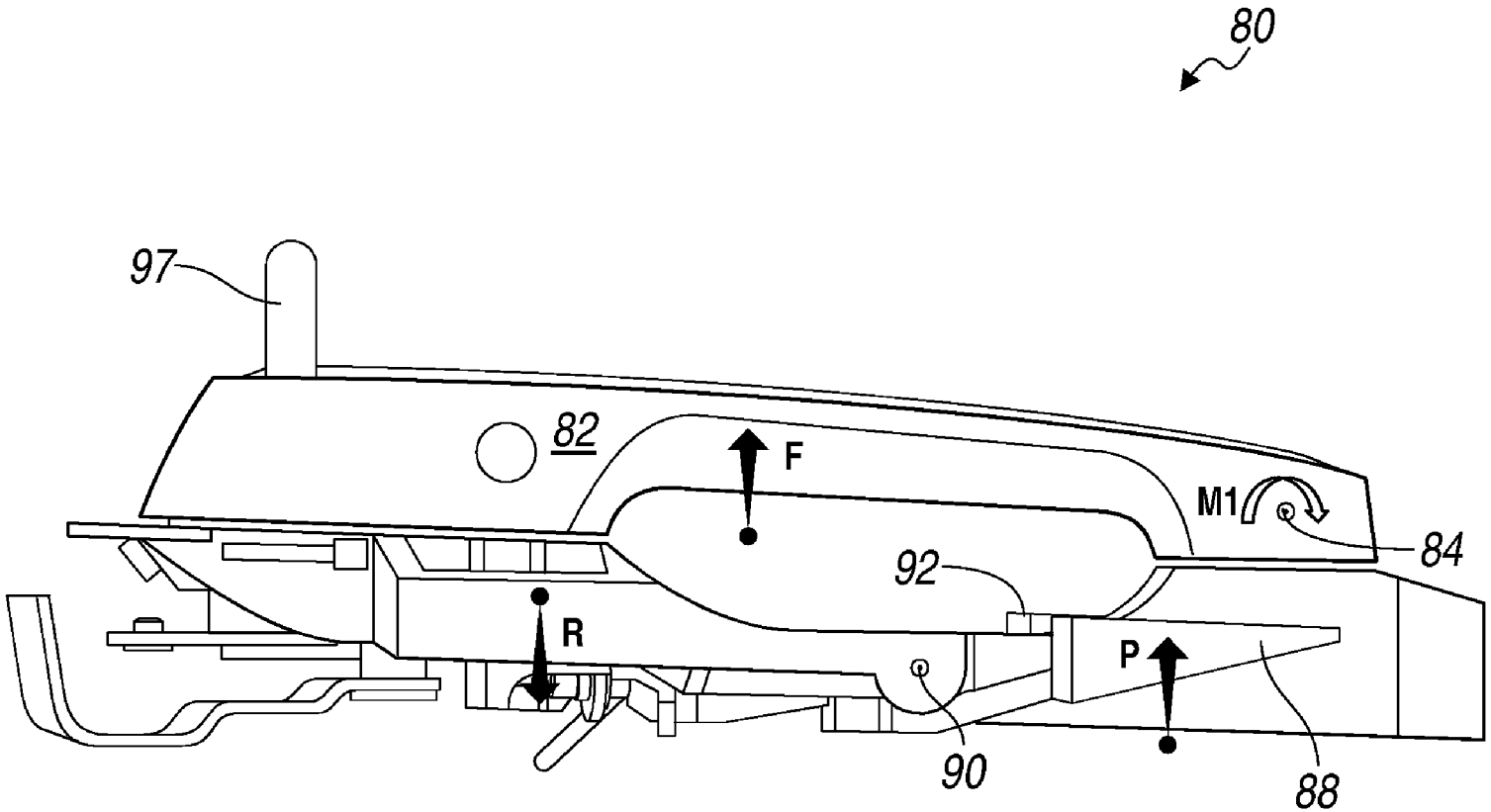
FIG. 4 is a top view of the door handle assembly according to a third embodiment.
Figure 5:
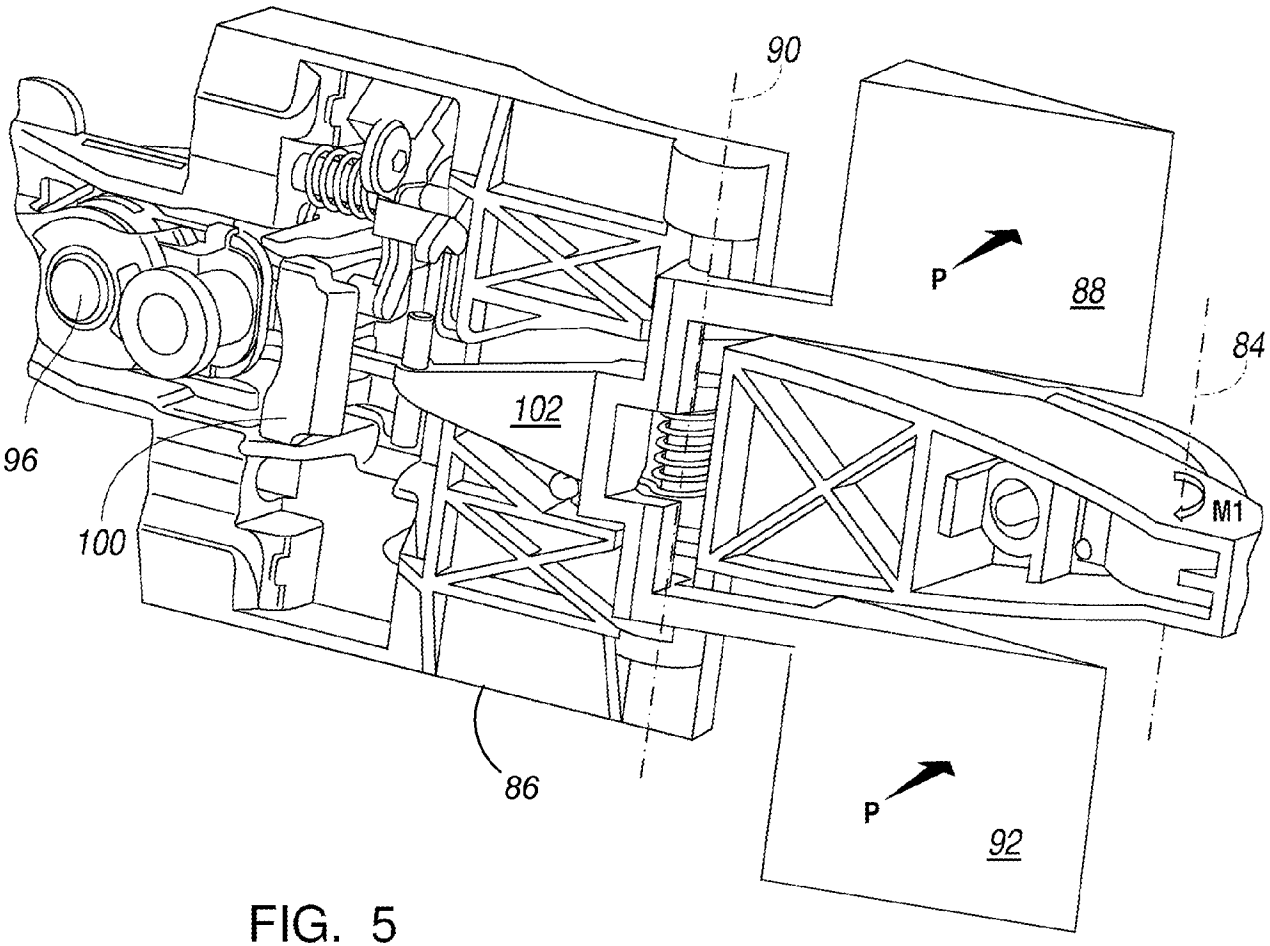
FIG. 5 is an inboard perspective view of the door handle assembly of FIG. 4.

In the event of a vehicle impact event, lateral acceleration of the door paddle relative to the bracket 56 produces outboard directed inertia force F on door paddle 52 and a clockwise moment M1 about axis 54. Lateral acceleration also produces outboard inertia force P on masses 58, 62, which pivots the masses about axis 60, applies an inboard reaction R on actuation arm 70 and a counterclockwise moment about axis 54, which is balanced by the clockwise moment M1 produced by outboard inertia force on the door paddle 52. Because these moments are equal in magnitude and opposite in direction, the door paddle 52 remains stationary. The counter balanced masses 58, 62 are arranged such that they do not cause vertical inertia and produce very high G-force capacity in any direction of the inertia forces. FIG. 4 is a top view of a door handle assembly 80 for a vehicle side door, and FIG. 5 is an inboard perspective view of the door handle assembly 80 showing the door paddle 82 released and in its closed position, pivoted inboard about its pivot axis 84. A bracket 86, which is bolted to the inside of the door, supports the door paddle 82 at axis 84, and an upper mass 88 and lower mass 92 at their pivot axis 90. A key cylinder lever 96 rotates in response to rotation of a door key 97 to lock and unlock the door. The key 97 located in key cylinder lever 96 extends outboard from paddle 82. An actuation arm 100, secured to door paddle 82 and extending through an opening in bracket 86, is continually engaged by an arm 102 formed integrally with the two masses 88, 92 and extending forward from axis 90. In operation, when the door paddle 82 is released, actuation arm 100 moves inboard to the position shown in FIGS. 4 and 5, causing masses 88, 92 to pivot clockwise about axis 90. In the event of a vehicle crash, lateral acceleration of the door paddle relative to the bracket 86 produces outboard directed inertia force F on door paddle 82 and a clockwise moment M1 about axis 84. Lateral acceleration also produces outboard inertia force P on masses 88, 92, which pivots the masses about axis 90, applies an inboard reaction R on actuation arm 100 and a counterclockwise moment about axis 84, which is balanced by the clockwise moment M1 produced by outboard inertia force on the door paddle 82. Because these moments are equal in magnitude and opposite in direction, the door paddle 82 remains stationary. The counter balanced masses 88, 92 are arranged such that they cancel each other's vertical inertia and produce very high G-force capacity in any direction of the inertia forces.

While certain embodiments of the present invention have been described in detail, those familiar with the art to which this invention relates will recognize various alternative designs and embodiments for practicing the invention as defined by the following claims.

What is claimed is:

1. A door handle assembly coupled to a vehicle door comprising:

a door paddle supported to pivot about a first axis;

an actuation arm secured to the door paddle;

a first mass engaged with the actuation arm and supported to pivot about a second axis; and a second mass engaged with the actuation arm and supported to pivot about a third axis spaced from the second axis, the masses being arranged such that outboard displacement of the door paddle causes the masses to pivot in a first direction producing a first moment about the first axis and to open the vehicle door, and an outboard acceleration of the masses causes the masses to pivot in a second direction producing a second moment about the first axis that is substantially equal in magnitude and opposite in direction to the first moment to prevent the opening of the vehicle door.

2. The assembly of claim 1 wherein the first direction is inboard and the second direction is outboard.

3. The assembly of claim 1 wherein the first axis is substantially perpendicular to the second and third axes.

4. A method of operating a door handle assembly on a vehicle door comprising the steps of:

(a) pivotally supporting a door paddle about a first axis;

(b) securing an actuation arm to the door paddle and to first and second masses;

(c) pivotally supporting the first mass to pivot about a second axis;

(d) pivotally supporting the second mass to pivot about a third axis spaced from the second axis; and (e) arranging the masses such that outboard displacement of the door paddle causes the masses to pivot in a first direction producing a first moment about the first axis and to open the vehicle door, and an outboard acceleration of the masses causes the masses to pivot in a second direction producing a second moment about the first axis that is substantially equal in magnitude and opposite in direction to the first moment to prevent opening of the vehicle door.

5. The method of claim 4, wherein in step (e) the first direction is inboard and the second direction is outboard.

6. A door handle assembly coupled to a vehicle door comprising:

a door paddle supported to pivot about a first axis;

first and second actuation arms secured to the door paddle;

a first mass engaged with the first actuation arm and supported to pivot about a second axis; and a second mass engaged with the second actuation arm and supported to pivot about a third axis spaced from the first axis, the masses being arranged such that outboard displacement of the door paddle causes the masses to pivot in a first direction producing a first moment about the first axis and to open the vehicle door, and an outboard acceleration of the masses causes the masses to pivot in a second direction producing a second moment about the first axis that is substantially equal in magnitude and opposite in direction to the first moment to prevent the opening of the vehicle door.

7. The assembly of claim 1 wherein the first direction is inboard and the second direction is outboard.

* * * * *